United States Patent [19]

Hayes

[11] Patent Number: 4,657,153

[45] Date of Patent: Apr. 14, 1987

[54] TAMPER-EVIDENT CLOSURE

[75] Inventor: Thomas H. Hayes, Lancaster, Ohio

[73] Assignee: Anchor Hocking Corporation, Lancaster, Ohio

[21] Appl. No.: 799,328

[22] Filed: Nov. 18, 1985

[51] Int. Cl.[4] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 4,196,818 | 4/1980 | Brownbill | 215/252 |
| 4,394,918 | 7/1983 | Grussen | 215/252 X |
| 4,478,343 | 10/1984 | Ostrowsky | 215/252 |
| 4,506,795 | 3/1985 | Herr | 215/252 |
| 4,511,054 | 4/1985 | Shank | 215/252 |
| 4,550,844 | 11/1985 | Lininger | 215/252 |

*Primary Examiner*—Donald F. Norton

*Attorney, Agent, or Firm*—Stoll, Wilkie, Previto & Hoffman

[57] ABSTRACT

A tamper-evident closure cap is described which is easily applied to a cantilever and which thereafter may not be removed without the separation of a tamper indicating band. Locking tabs on the tamper indicating band are hinged to the band with and over-center hinge means for facilitating the effective tab position on a sealed container.

4 Claims, 10 Drawing Figures

Fig. 6.
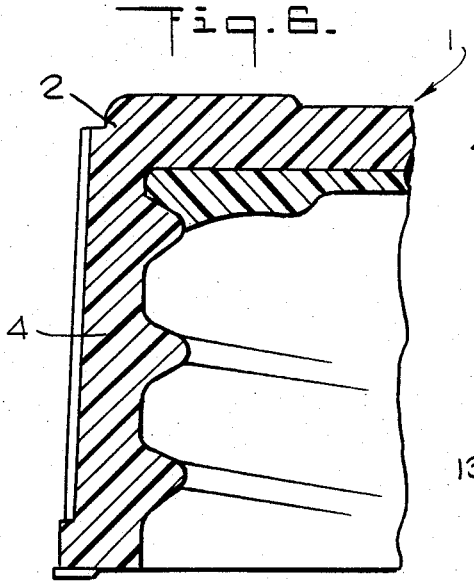
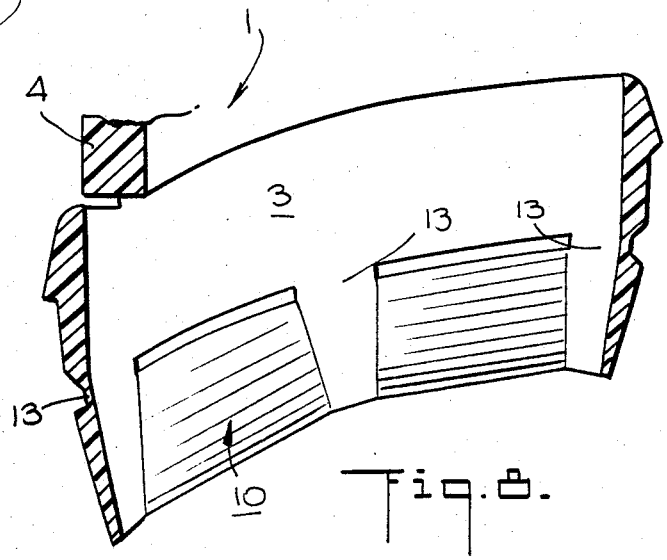
Fig. 8.
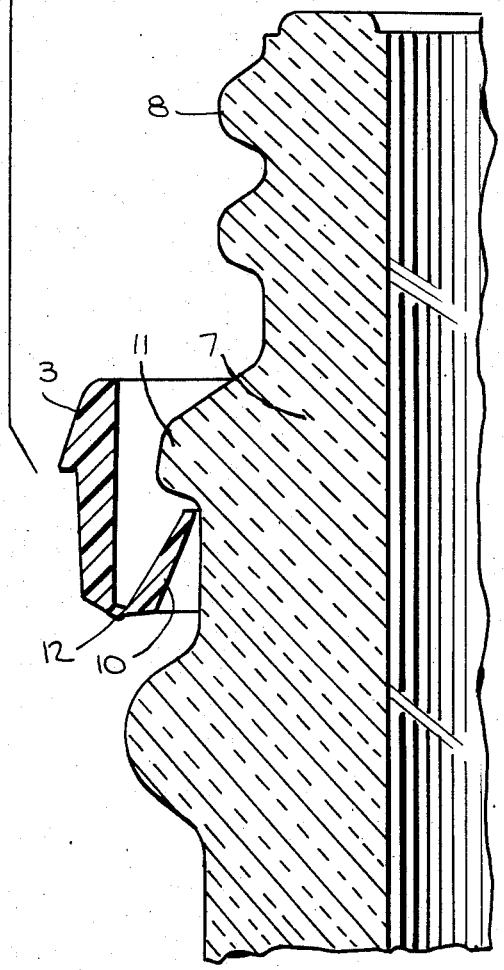
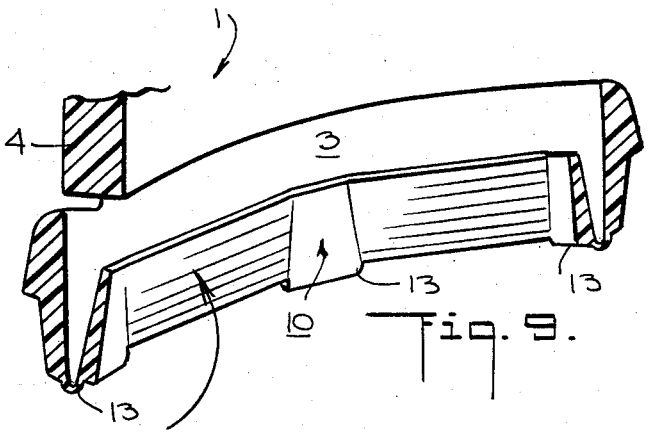
Fig. 9.
Fig. 7B.
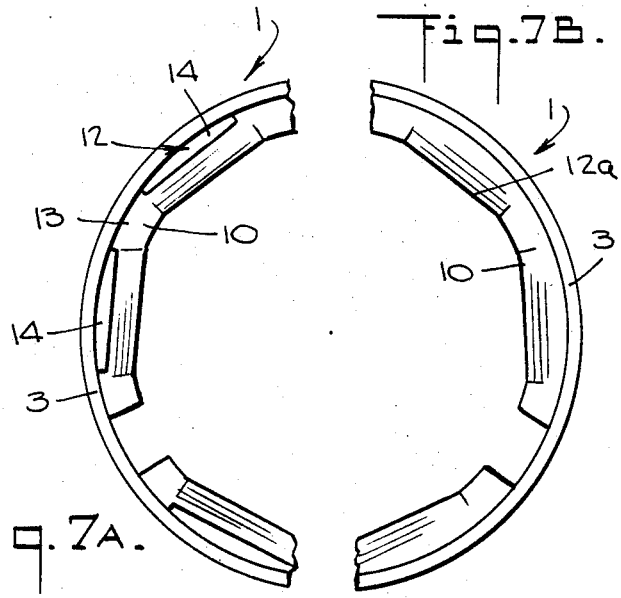
Fig. 7A.

TAMPER-EVIDENT CLOSURE

BACKGROUND OF THE INVENTION

The present invention relates to closure caps of the type which are used to seal containers and which are tamper-evident and which may not be removed from the container without a clear indication to others that the package has been opened or tampered with.

There are a number of presently known closure caps which are designed to provide an indication that they have been removed or partially removed from the container. These are supplied to meet a growing problem in the use of regular closures in that these regular closures may be all or partially removed and reapplied without any indication that the packaged products have been exposed or tampered with.

A number of well known incidents recently have resulted in fatalities from unauthorized tampering with and from the addition of harmful ingredients to originally tightly sealed packages.

The present closure cap represents an improvement over a number of prior closure caps which include indications that there has been a previous and unauthorized opening of the sealed container. In particular, a tamper-evident closure is provided which is easily molded and which is sealed on a container without unintentional damage to the indicator band and with an over-center hinge action in the indicator band tabs which facilitates the handling of and application of the closures.

Accordingly, an object of the present invention is to provide an improved tamper-evident closure.

Another object of the invention is to provide a more easily applied and more reliable tamper-evident closure.

Other and further objects of the present invention will be apparent upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification wherein:

FIGS. 3 and 6 are vertical, sectional views of the closure and container mouth.

FIGS. *7a* and *7b* are bottom plan views of two embodiments of the closure.

FIGS. 8 and 9 are enlarged, fragmentary perspective views of the tamper indicating band and tabs in the initially molded and sealing positions respectively.

DESCRIPTION OF THE PREFERRED EMBODIMENTS

This invention is an improved closure cap of the type known as a tamper-evident closure. The closure caps illustrated herein and described below are caps which may not be removed without an indication of tampering. Such closures are now commonly known as "tamper-evident" closures.

Figure 1:
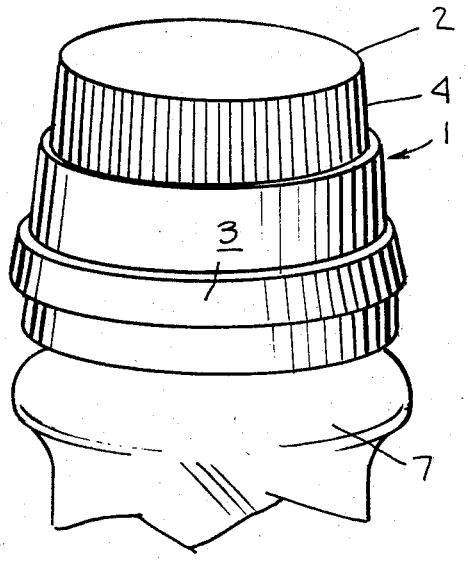
FIG. 1 is a perspective view of a preferred embodiment of the closure of the present invention on a container.

FIGS. 1 through *7a* and 8 and 9 illustrate one embodiment of a tamper-evident closure 1. The closure 1 comprises an outer closure shell 2 including an integral tamper-evident band 3 encircling and attached to the lower edge of the closure cap skirt 4. The skirt 4 has threads 6 for engaging the container threads 8. The closure includes a sealing gasket 9. The tamper-evident band 3 is molded as an integral part of the outer shell 2 including a number of tabs 10 which flex inwardly and upwardly (FIG. 5) to pass over a container bead 11 during cap application. The band 3 is held downward (FIG. 6) during closure removal by the bead 11 tearing the band 3 from the outer cap shell 2, thereby providing the tamper indication. The inwardly projecting tabs 10 of the band 3 are attached to the remainder of the band 3 at a novel hinge means 12 as will be more fully explained below.

Figure 3:
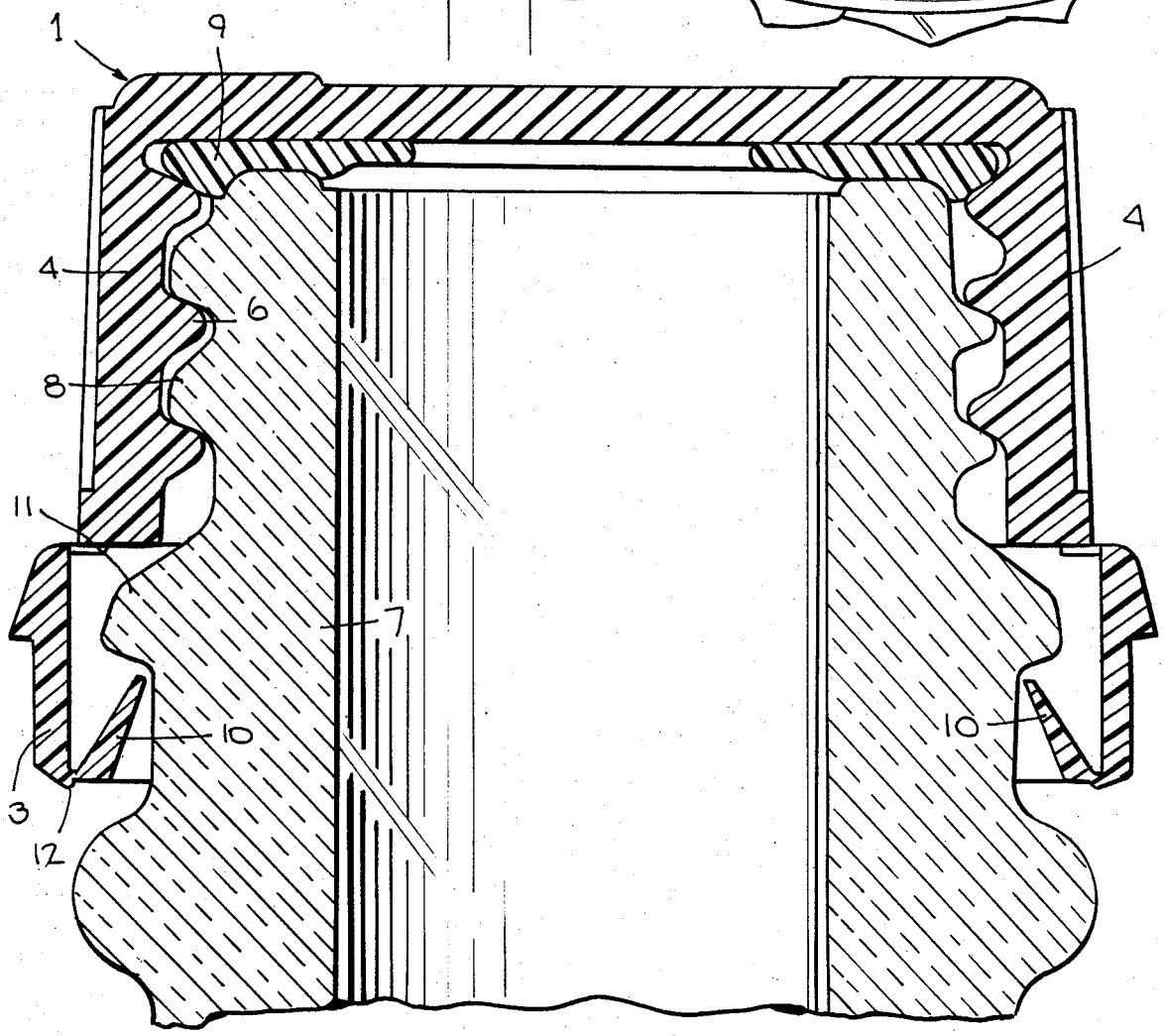

FIG. 1 illustrates the closure 1 sealing a container 7. The closure 1 is screwed onto the container threads 8 with the tamper indicating band 3 positioned at the container bead 11. FIG. 3 illustrates the closure 1 in its sealing position with the tamper indicating band 3 positioned outwardly of the container bead 11 and with the inwardly projecting tabs 10 of the band 3 turned beneath the bead 11.

A particular improvement incorporated in the closure of this application is in the hinge means 12 which attaches the tabs 10 to the lower edge of the tamper indicating band 3. As already noted, the tabs 10 are formed as an integral part of the molded closure cap. When molded, tabs 10 project downwardly from the remaining portion of the band as illustrated, for example, in FIG. 4. Prior to application to the container 7 and preferably prior to a shipment of the completed caps from their point of manufacture to the container sealing location, each of the tabs 10 is swung inwardly to the position illustrated in FIG. 3 where the tabs 10 project inwardly and upwardly from the lower edge of the band 3. This facilitates the application of the closure 1 and insures that each of the tabs 10 pass downwardly over the container bead 11 and occupy a bead engaging position, as illustrated in FIG. 3, at the conclusion of the sealing operation. Additionally, such an inward and upward and protected position for the individual tabs 10 insures against damage to the tabs 10 during shipment.

Figure 4:
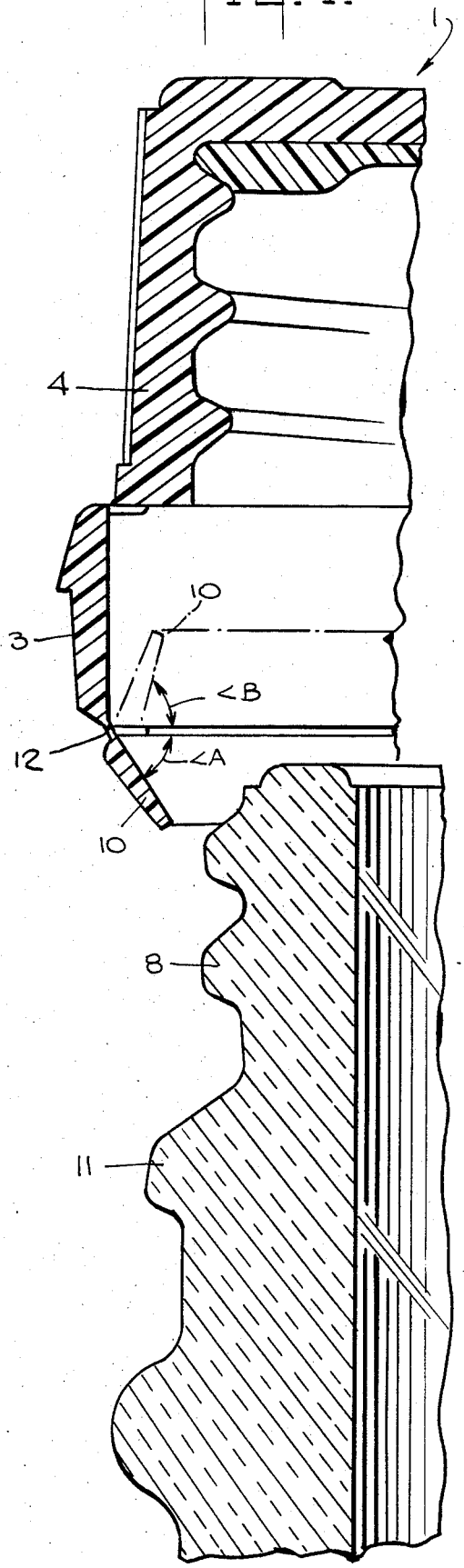

The preferred tabs 10 of this invention are connected to the tamper indicating bands 3 by an over-center or snap action hinge 12 which facilitates their movement from an initial outward molded position to an inward protected shipping and sealing position. An over-center hinge or snap-action results from the hinge 12 describing a significant portion of an arc, which is an arcuate portion of the circular lower edge of the tamper indicating band. A limited number of tabs are employed so that the hinge line of each one occupies a significant arcuate portion of the perimeter of the tamper indicating band, for example, three tabs 10 are usefully employed, each of which extends for some 100° or so along the perimeter of the tamper indicating band 3, as illustrated in FIG. *7a* and *7b*. The over-center or snap-action is the automatic result of employing such an arcuate shape for the hinged tabs 10 as each tab 10 in its molded position will be at rest in a neutral position and whereas any hinge-like movement of the individual tabs 10 inwardly from this point will cause them after they pass the plane of the circular band 3 edge to snap to a rest position some 90° or so beyond the original position as illustrated in FIG. 4. Each tab 10 will then snap from angle A (FIG. 4) to a corresponding angle B.

Advantage is therefore taken of this snap-action after the molding of the cap to swing the tabs 10 to their inner protected position by a slight initial inward movement applied individually or simultaneously to the several tabs 10.

The hinge means 12 itself may comprise a zone of weakness along an arcuate hinge line, such as a groove or slot 12*a* (FIG. 7*b*) or it may comprise a number of hinges 13 such as the three hinges 13 illustrated in FIG. 7*a* with intermediate slots 14.

In order to obtain an adequate snap-action the hinges on closure caps or popular closure sizes between about 28 mm. and 90 mm have hinged portions which extend between about 60 and 120° of arc insuring that the energy forces employed in the hinge are sufficient to overcome irregularities and other sources of resistance to hinging present in molded closures or other articles of this general shape.

Therefore, the novel effect which is the subject of this invention is realized in closures having from 2 tabs occupying a significant portion of the indicating band 3 rim to some half dozen tabs 10 occupying some 60 degrees of arc each along the tamper indicating band 3 rim. The improved result is not present in closure caps utilizing large numbers of tabs occupying lesser arcs along the rim, such as caps having more than about 12 tabs and the presently known caps having as many as about 20 tabs. These narrower tabs do not have a hinge portion of sufficient length to provide sufficient over-center energy to snap the tabs inwardly to their sealed position as described above. For example prior U.S. Pat. Nos. 4,196,818; 4,506,795 and 4,511,054 illustrate tabs occupaying some 10° to about 20° of arc while prior U.S. Pat. No. 4,394,918 has a lesser number of tabs hinged at about 20° or less of arc and a number of prior patents such as U.S. Pat. Nos. 4,418,828 and 4,497,765 have straight tab hinges at an angle to the band edges.

An additional advantage of the tabs with larger hinges, as described above, is that it permits them to be molded in thinner form in radial cross section while retaining a sufficient strength at the line-of-weakness of hinge line to resist accidental rupture. The tabs 10 on the improved closure therefore may be made relatively thin in the relative dimensions as illustrated with a significant saving of material while providing effective tear-off action.

Figure 2:
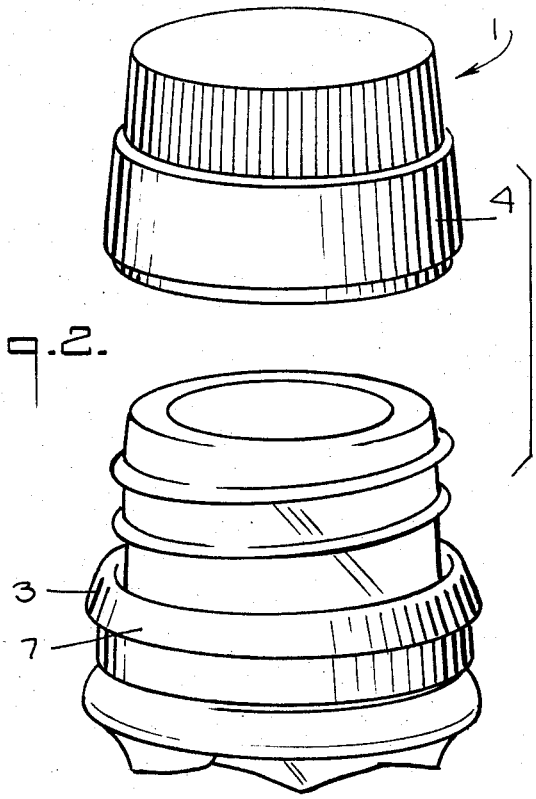
FIG. 2 is a perspective view of the closure of FIG. 1 removed from the container.

FIG. 2 shows the closure cap 1 after its removal from the container 7. The removal, as illustrated in FIGS. 2 and 6, has caused the tamper indicating band 3 to be torn from the remainder of the closure 1 with the band 3 remaining on the container 7 thereby making it evident that the closure 1 has been either fully or partially removed from the container 7. Sectional view FIG. 6 illustrates the tamper indicating action of the portion 10 of the band 3 with the container bead 11. It is evident from the above described structure and particularly from FIG. 6 that even a partial removal or tampering with the closure 1, when it is turned off for only a turn or so, snaps the tamper indicating band 3 free of the closure 1. The resulting and evident separation of the band 3 from the remainder of the closure 1 provides a clear tamper indication.

A significant advantage results from the above described form and action of the tabs 10 on the tamper indicating band 3. The band 3 is formed as an integral part of the closure cap 1 in a unitary mold projecting downwardly from the closure skirt 4.

The band 3 is releasably attached to the closure skirt 4 by a frangible coupling. This coupling may comprise a series of spaced bridges or alternatively a reduced shell thickness in the form of a line or groove encircling the cap skirt. By these means or other known means, a line of weakness is provided between the tamper indicating band 3 and the remainder of the closure cap 1. The line of weakness releases the tamper indicating band 3 when it is subjected to the relatively high forces created during cap removal but is undamaged during the cap application which subjects the band 3 to only minor forces resulting from the passage of the already inwardly bent tabs 10 over the container bead 11.

Figure 5:
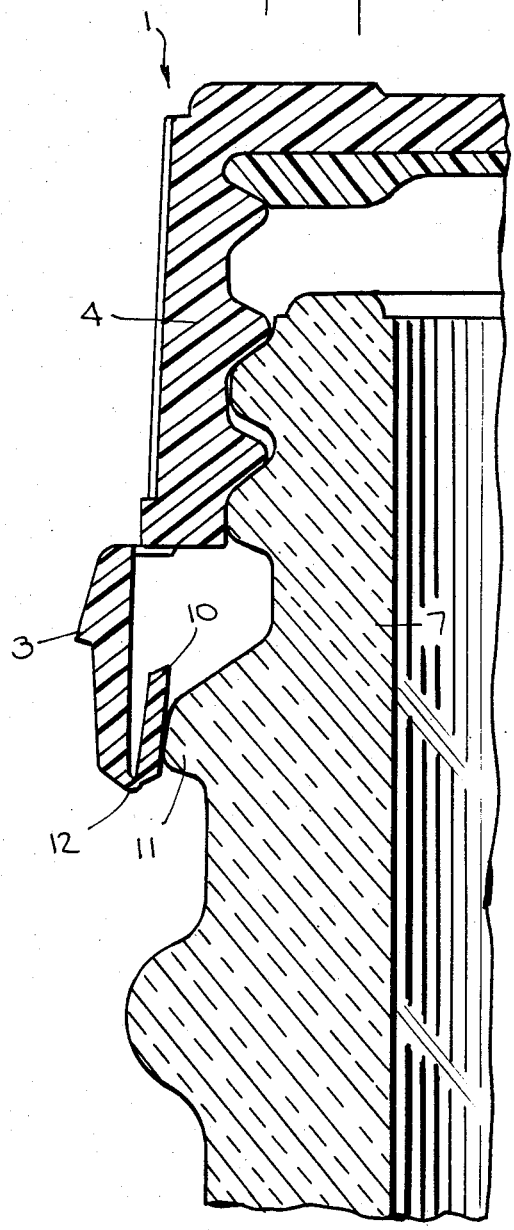

FIG. 5 illustrates the closure 1 being moved downwardly over a container 7 preparatory to its being screwed onto the container threads 8 to form a seal at the gasket 9. The inwardly projecting and inwardly snapped tabs 10, which are molded in the downwardly projecting position as illustrated in FIG. 4 and have been snapped inwardly to the inner position shown in dash-dot lines in FIG. 4, engage the outer edge of the container 7 and particularly the bead 11 (FIG. 5). Bead 11 swings the tabs 10 to a generally vertical position as the tabs 10 turn on their hinge means 12 as the tabs 10 pass downwardly over the bead 11. When the closure cap 1 reaches its fully sealed position, as illustrated in FIG. 3, the tabs 10 swing radially inwardly to the sealed position illustrated in FIG. 3.

When the closure 1 is turned off, the tabs 10 are confined by the bead 11 and the adjacent container 7 surface thereby generating a significant downward holding force on the indicating band 3 tearing it loose from the remainder of the closure cap 1 as illustrated in FIG. 6.

It will be seen that an improved tamper-evident closure has been described wherein this feature is provided by cooperating elements easily formed on the cap during the cap molding. The tamper-evident feature including the over-center tab hinging is such that the indicator is easily applied without rupture during sealing and is positively torn clear of the rest of the closure by the closure removal.

Damage to, or displacement of this band provides a clear indication that there has been a previous attempt to open the container. This will give the package purchaser or user a clearly visible indication of the status of the package and will guard him against the purchase of a package where an unauthorized attempt has been made to open it.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

What is claimed is:

1. A molded plastic tamper-indicating closure for sealing a container having closure engaging members on the container neck and an annular bead therebelow comprising the combination of:

a cup-like shell with a cover and a depending skirt;

means on said shell for engaging the closure engaging members;

a circular tear strip releasably attached to the lower edge of said skirt;

a plurality of separate radially inwardly projecting tabs each being hingedly connected by a snap-action arcuate over-center hinge means at the lower edge of said tear strip for locking engagement between the container bead and said tabs; and said hinge means comprising a plurality of spaced hinges between said tear strip and said tabs and separated from each other by arcuate slots.

2. The closure as claimed in claim 1 in which said tabs comprise three tabs each having a hinge means with an arc of about 100 degrees.

3. The closure as claimed in claim 1 in which said tabs comprise a plurality of tabs each having a hinge means with an arcuate length of about 60 to 100 degrees of arc.

4. The closure as claimed in claim 1 in which said tabs have an original molded position downwardly from the plane of the circular tear strip and a second over-center position extending inwardly and upwardly from the said plane.

* * * * *